US010309277B2

(12) United States Patent
Wiebrecht

(10) Patent No.: US 10,309,277 B2
(45) Date of Patent: Jun. 4, 2019

(54) TANK FOR DRY SUMP LUBRICATION SYSTEM

(71) Applicant: Caterpillar Inc., Peoria, IL (US)

(72) Inventor: Eric D. Wiebrecht, East Peoria, IL (US)

(73) Assignee: Caterpillar Inc., Deerfield, IL (US)

( * ) Notice: Subject to any disclaimer, the term of this patent is extended or adjusted under 35 U.S.C. 154(b) by 185 days.

(21) Appl. No.: 15/401,168

(22) Filed: Jan. 9, 2017

(65) Prior Publication Data

US 2018/0195422 A1 Jul. 12, 2018

(51) Int. Cl.
*F01M 11/00* (2006.01)
*F01M 11/04* (2006.01)

(52) U.S. Cl.
CPC ..... *F01M 11/0004* (2013.01); *F01M 11/0458* (2013.01); *F01M 2011/0029* (2013.01); *F01M 2011/0083* (2013.01)

(58) Field of Classification Search
CPC .... F01M 11/0004; F01M 11/04; F01M 11/00; F01M 11/0458; F01M 2001/126
See application file for complete search history.

(56) References Cited

U.S. PATENT DOCUMENTS 5,755,194 A 5/1998 Moorman et al.
7,017,546 B1 3/2006 Patel et al.
2017/0138232 A1* 5/2017 Hellman ..... A01D 69/00

FOREIGN PATENT DOCUMENTS

DE 102013113963 6/2015
WO 2012171620 5/2013

OTHER PUBLICATIONS

AMG GT S Dry-Sump Lubrication, https://www.mbusa.com/mercedes/vehicles/model/class-GTS/model-GTS, Accessed Nov. 18, 2016, prior to Application Filing Date.
Hib Halverson: Ruthless Pursuit of Power: The Mystique of the C6 Corvette LS7 Engine—p. 9 of 26 © May 2013—Updated: Nov. 2014.

* cited by examiner

*Primary Examiner* — Kevin A Lathers

(57) ABSTRACT

A tank for a dry sump lubrication system for an internal combustion engine is disclosed. The tank includes a body having a first portion, a second portion, and defines an inner chamber. The tank also includes a filter housing integrally formed with the first portion and disposed inside the inner chamber. The filter housing is configured to receive a filter. Further, the body and the filter housing are formed by a blow molding process.

20 Claims, 3 Drawing Sheets

TANK FOR DRY SUMP LUBRICATION SYSTEM

TECHNICAL FIELD

The present disclosure relates generally to a dry sump lubrication system for an internal combustion engine. More particularly, the disclosure relates to a tank having an integrated filter housing for the dry sump lubrication system for the internal combustion engine.

BACKGROUND

Engines either include a wet sump lubrication system or a dry sump lubrication system for lubricating various engine components. In the wet sump lubrication system, lubricating oil is stored within the engine in an oil pan that is disposed below a crankcase of the engine. However, storing the lubricating oil within the engine may cause an increase in an overall size of the engine. Due to the increased size of the engine, an assembling of the engine may be difficult in constrained spaces.

To overcome such space constraints, the dry sump lubrication system may be applied. In the dry sump lubrication system, the lubricating oil is stored in a reservoir or a tank, which is separate from a sump portion of the crankcase of the engine. Such a tank is generally located externally to the engine. During operation of the engine, the lubricating oil is pumped from this tank to the engine and is returned to the tank. However, the dry sump lubrication system may include additional components that may add to the cost and complexity of the engine.

WIPO Application 2012171620 relates to an oil tank for a motor vehicle with dry sump lubrication. The oil tank includes two components which define a closed hollow space for accommodating an oil. The first component is a cast component and the second component is a sheet metal component.

SUMMARY OF THE INVENTION

In one aspect, the disclosure is directed towards a tank for a dry sump lubrication system for an internal combustion engine. The tank includes a body having a first portion, a second portion, and defines an inner chamber. The tank also includes a filter housing integrally formed with the first portion and disposed inside the inner chamber. The filter housing is configured to receive a filter. Further, the body and the filter housing are formed by a blow molding process.

In another aspect, the disclosure relates to a dry sump lubrication system for an internal combustion engine. The dry sump lubrication system includes a tank that is configured to store a lubricating oil. The tank includes a body having a first portion, a second portion, a filter housing, and a filter. The tank defines an inner chamber. The filter housing is integrally formed with the first portion and is disposed inside the inner chamber. Further, the body and the filter housing are formed by a blow molding process. The filter is disposed inside the filter housing and is configured to filter the lubricating oil received from the internal combustion engine.

DETAILED DESCRIPTION

Figure 1:
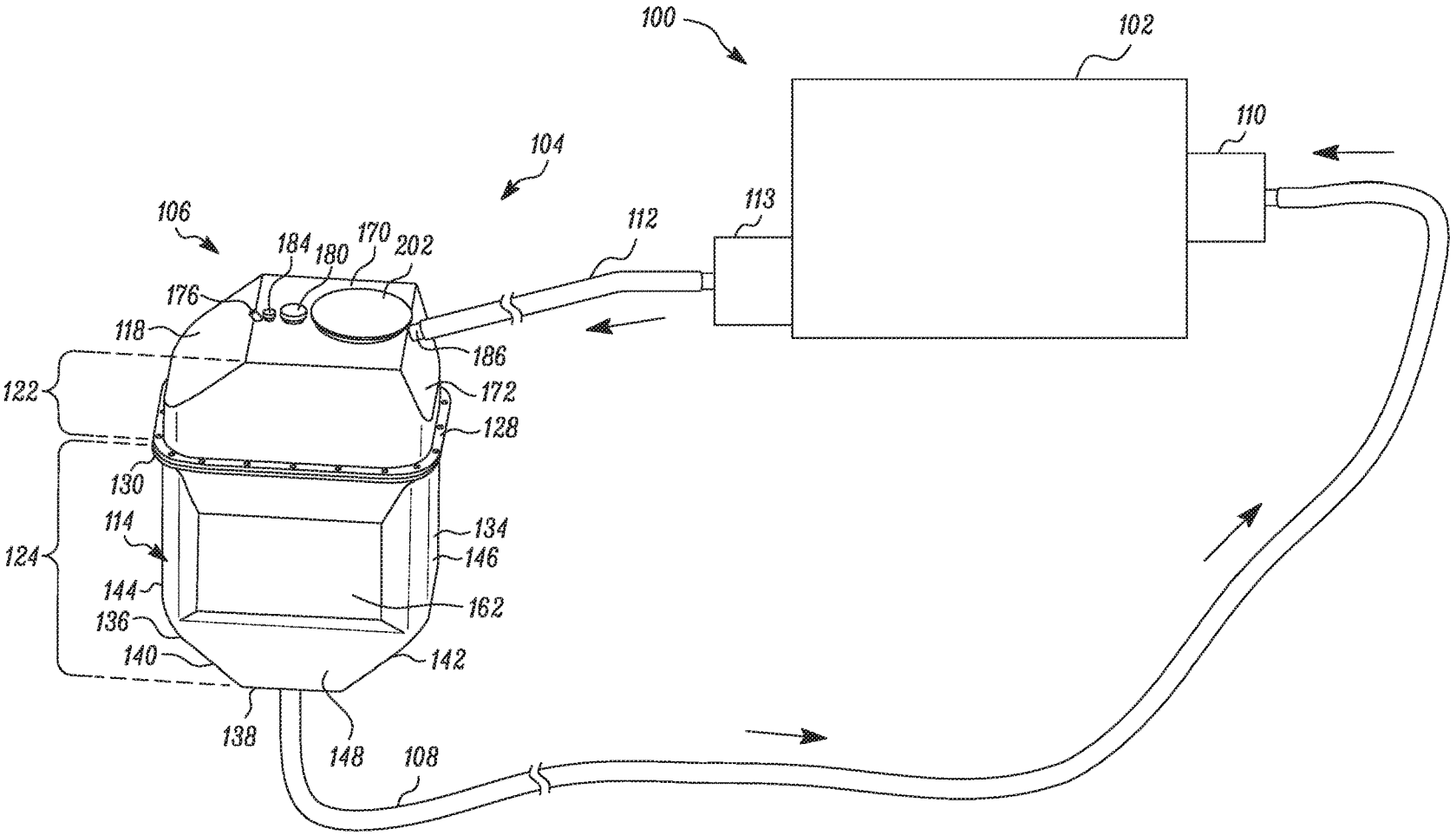
FIG. 1 is a schematic and a diagrammatic illustration of an exemplary engine system having an internal combustion engine and a dry sump lubrication system having a tank assembly, in accordance with the concepts of the present disclosure.

Referring to FIG. 1, there is shown an engine system 100. The engine system 100 may include an internal combustion engine 102 (or simply an engine 102) and a dry sump lubrication system 104. The engine system 100 may be applied within construction machines, such as off-highway trucks, loaders, tractors, excavators, dozers, loaders, compactors, or any other construction machine, agricultural machine, mining machine, earth moving machine, etc.

The dry sump lubrication system 104 may be configured to supply oil, such as a lubricating oil, to the engine 102 and certain associated components of the engine 102, for lubrication purposes. The dry sump lubrication system 104 may include a tank assembly 106, a supply conduit 108, and a pump 110 that is configured to pump the lubricating oil from the tank assembly 106 to the engine 102 via a supply path defined by the supply conduit 108. A return conduit 112 may also be provided that facilitates a return of a used lubricating oil, back to the tank assembly 106. In an implementation, a pump 113 may pump the lubricating oil from the engine 102 to the tank assembly 106. The tank assembly 106 of the dry sump lubrication system 104 is placed remotely from the engine 102, and is fluidly connected to the engine 102 via the supply conduit 108 and the return conduit 112.

Figure 2:
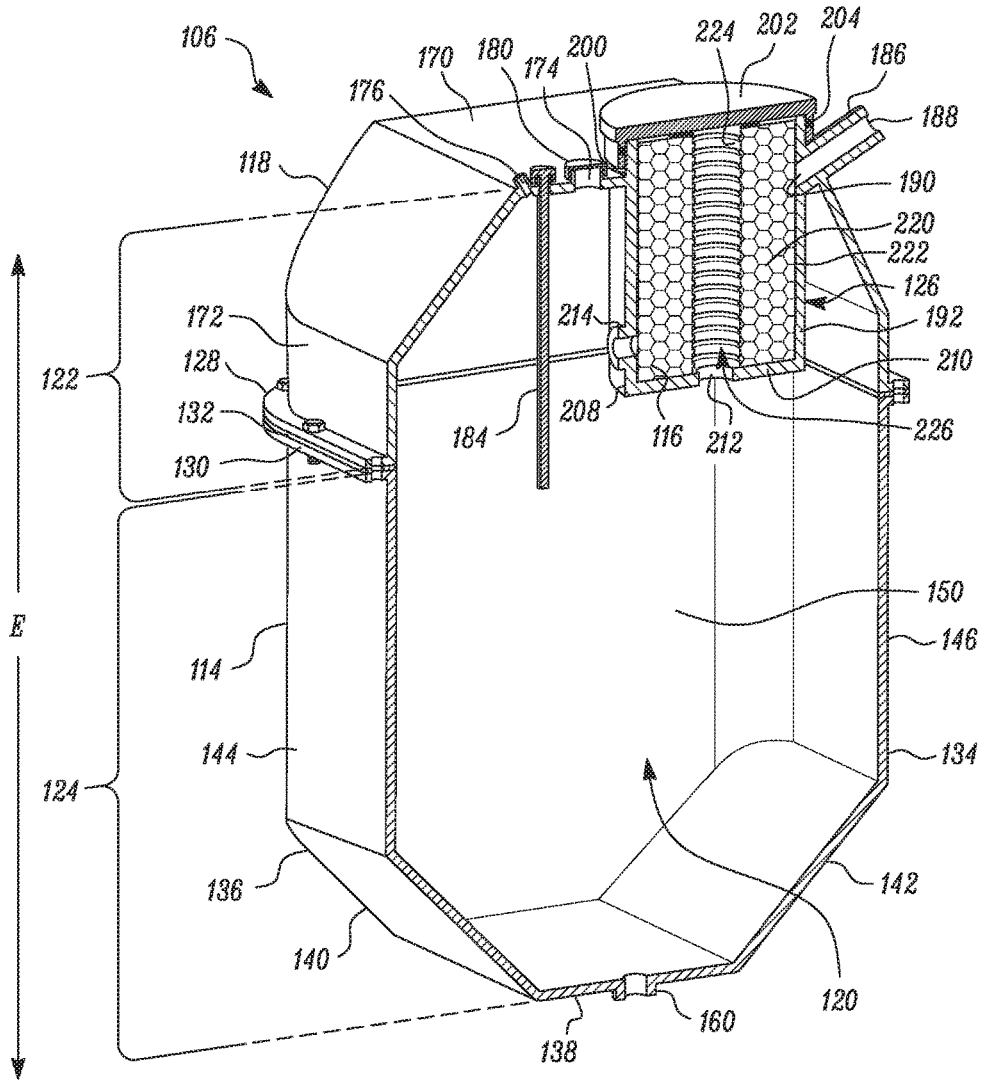
FIG. 2 is a sectional perspective view of the tank assembly having a tank, in accordance with the concepts of the present disclosure.
Figure 3:
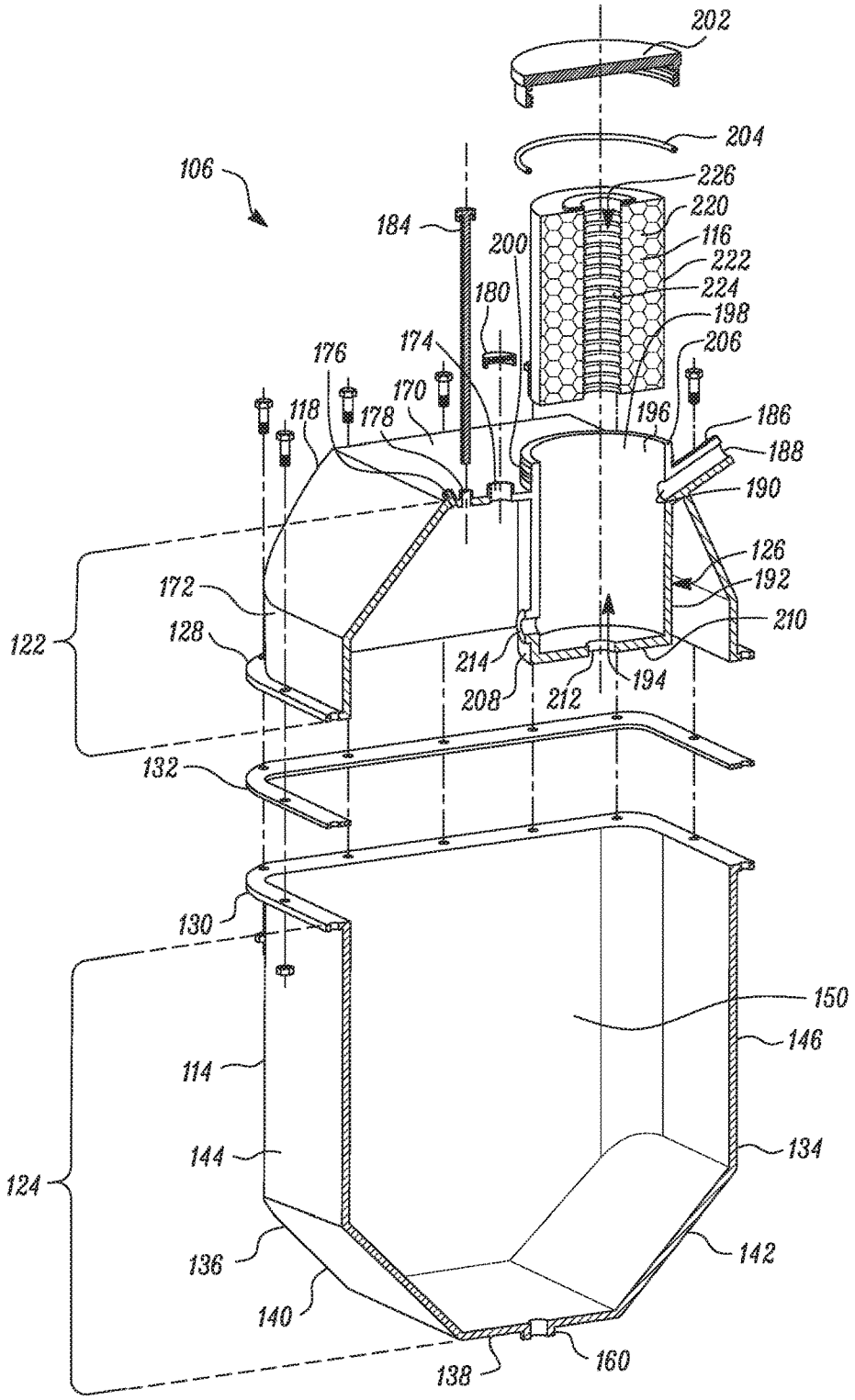
FIG. 3 is an exploded sectional view of the tank assembly, in accordance with the concepts of the present disclosure.

Referring to FIGS. 2 and 3, the tank assembly 106 is depicted and discussed. The tank assembly 106 includes a tank 114 that is configured to store the lubricating oil, and a filter 116 that filters the lubricating oil prior to storage within the tank 114. The tank 114 includes a body 118 that defines an inner chamber 120, and includes a first portion 122 and a second portion 124. The tank 114 further includes a filter housing 126 integrally formed with the first portion 122 and extending into the inner chamber 120. The first portion 122 and the second portion 124 are coupled to each other to form the tank 114 and define the inner chamber 120 of the body 118 of the tank 114. In an embodiment, the body 118 and the filter housing 126 are formed by a blow molding process. As shown in FIGS. 2 and 3, the first portion 122 and the second portion 124 are two different components that are manufactured separately by the blow molding process, and are assembled together to form the tank 114. In such a case, the filter housing 126 is formed with the first portion 122 during manufacturing of the first portion 122 by the blow molding process.

In certain implementations, the first portion 122 may be adapted to be vertically arranged and assembled atop the second portion 124 in one configuration of the tank 114 as shown in FIGS. 1, 2, and 3. Such a configuration may define an elevation, E, of the body 118, which is denoted in FIG. 2. Both the first portion 122 and the second portion 124 may include a U-shaped profile. In some implementations, such as in the embodiment depicted in FIGS. 1, 2, and 3, the first portion 122 may be assembled atop the second portion 124 in an inverted manner, such that the first portion 122 acquires an inverted U-shaped profile relative to the second portion 124. Further, the first portion 122 may include a first flange 128 and the second portion 124 may include a second flange 130. To enable an assembly between the first portion 122 and the second portion 124, the first flange 128 is fastened and/or coupled to the second flange 130. To establish such a fastening, bolts, rivets, or other conventionally available fasteners, may be used. Further, a seal, such as a gasket 132, may be provided between the first flange 128 and the second flange 130 to prevent leakage of lubricating oil from the inner chamber 120. Alternatively, the tank 114 may be formed by the blow molding process as single unit, having the filter housing 126 integrally formed with the first portion 122 of the body 118.

As shown in FIGS. 2 and 3, the second portion 124 includes a side structure 134, and a bottom structure 136 having a base 138 and one or more side walls extending between the base 138 and the side structure 134. The one or more side walls may be inclined to both the base 138 and the side structure 134. In an embodiment, the one or more side walls may include, for example, a first side wall 140 and a second side wall 142, each extending between the base 138 and the side structure 134. In an exemplary scenario, the side structure 134 may include one or more walls extending from the bottom structure 136 to the second flange 130. The one or more walls of the side structure 134 may include, for example, a first wall 144, a second wall 146, a front wall 148 (see FIG. 1) extending between the first wall 144 and the second wall 146, and a back wall 150 facing the front wall 148 and extending between the first wall 144 and the second wall 146. The first side wall 140 extends from the base 138 to the first wall 144, and is inclined to both the first wall 144 and the base 138. Similarly, the second side wall 142 extends from the base 138 to the second wall 146, and is inclined to both the second wall 146 and the base 138. As an example, an included angle between the base 138 and the side walls 140, 142 may be an obtuse angle. Further, an included angle between the side structure 134 and the side walls 140, 142 may also be an obtuse angle. For example, as shown, the included angle between the first side wall 140 and the first wall 144 is an obtuse angle, and the included angle between the second side wall 142 and the second wall 146 is also an obtuse angle. Further, each of the front wall 148 and the back wall 150 may be attached to the base 138.

Further, the second portion 124 may include an outlet passage 160 formed in the base 138 that facilitates an exit of lubricating oil from the inner chamber 120 of the tank 114 into the supply conduit 108, and in turn into the engine 102 and the engine's associated components. As the side walls 140, 142 are inclined relative to the base 138, the lubricating oil is directed towards the outlet passage 160 formed in the base 138, minimizing retention of an unutilized amount of the lubricating oil inside the tank 114. The outlet passage 160 may be formed during the blow molding process or may be formed by performing a drilling operation on the base 138.

Also, the side structure 134 may include one or more bulged portions to increase a volume of the inner chamber 120. For example, as shown in FIG. 1, the front wall 148 includes a bulged portion 162 to increase a volume of the inner chamber 120. Although the bulged portion 162 is shown in the front wall 148, it may be appreciated that similar types of bulged portions may be included in the other walls of the side structure 134. Also, it may be noted that a size, a shape, and a number of the bulged portions, may depend upon a spatial confine in which the tank 114 is adapted to be accommodated. It may be appreciated that similar bulged portions may also be formed in the first portion 122 of the tank 114.

Again referring to FIGS. 2 and 3, the first portion 122 may include a header plate 170 and a wall 172 extending downwardly from the header plate 170. In an implementation, the wall 172 extends at an inclination to the header plate 170. Further, the first flange 128 is disposed at an end of the wall 172, away from the header plate 170. The header plate 170 may include a fill port 174, a vent port 176, and a dipstick opening 178. The fill port 174 is adapted to facilitate an entry of the lubricating oil into the inner chamber 120. In an embodiment, the fill port 174 may be formed during the blow molding process of the first portion 122 of the tank 114. Alternatively, the fill port 174 may be formed by performing a drilling operation on the header plate 170. Further, the tank 114 may include a fill plug 180 for covering the fill port 174. To enable a filling of the inner chamber 120 with lubricating oil, the fill plug 180 is removed from the fill port 174.

Further, the vent port 176 is formed in the header plate 170 and facilitates venting of air (or gases) from the inner chamber 120 to an outside of the tank 114. In an embodiment, the vent port 176 may be formed during the blow molding process of the first portion 122 of the tank 114. Alternatively, the vent port 176 may be formed by performing a drilling operation on the header plate 170. In certain implementations, a check valve (not shown) may be positioned in the vent port 176 to regulate an exit of the air (or gases) from the inner chamber 120, and prevent an entry of air from the atmosphere into the inner chamber 120.

The dipstick opening 178 may be adapted to facilitate an insertion of a dipstick 184 into the inner chamber 120 to measure a level of lubricating oil (or any fluid) stored in the tank 114, at any given point. In an assembled position of the dipstick 184 with the tank 114, the dipstick 184 is positioned to extend through the dipstick opening 178. To check a level of lubricating oil in the inner chamber 120, an operator may remove the dipstick 184 from the dipstick opening 178 and visually analyze a length of the dipstick 184 on which the lubricating oil is present. In an embodiment, the dipstick opening 178 may be formed during the blow molding process of the first portion 122 of the tank 114. Alternatively, the dipstick opening 178 may be formed by performing a drilling operation on the header plate 170.

Further, the tank 114 includes an inlet conduit 186 that extends from the first portion 122 of the body 118 of the tank 114 to the filter housing 126. The inlet conduit 186 facilitates a flow of a lubricating oil from the engine 102 to the filter housing 126. As shown, a portion of the inlet conduit 186 extends outwardly from the wall 172 and a remaining portion of the inlet conduit 186 extends inwardly from the wall 172 into the inner chamber 120 to the filter housing 126. The inlet conduit 186 includes an inlet opening 188, and an outlet opening 190 formed in the filter housing 126.

The filter housing 126 may be disposed inside the inner chamber 120, and is configured to receive the filter 116. The filter housing 126 includes a wall 192 extending at least partially from the header plate 170 of the first portion 122 into the inner chamber 120. The wall 192 may include a cylindrical structure that defines a cavity 194 (see FIG. 3) to house the filter 116. Further, an aperture 196 is formed in the header plate 170 of the first portion 122 that defines an opening 198 of the cavity 194. The opening 198 facilitates a removal of the filter 116 from the filter housing 126. Further, a portion 200 of the wall 192 may extend partially outwardly from the header plate 170. A cap 202 may be engaged with the portion 200 to cover the opening 198 of the aperture 196. The cap 202 may be engaged with the portion 200 by a threaded engagement. Alternatively, the cap 202 may be coupled to the portion 200 by a snap fit engagement.

In certain implementations, a seal 204 may be positioned between the cap 202 and an upper end 206 or the portion 200 of the wall 192 to prevent egress of the lubricating oil from the filter housing 126. In an embodiment, the fill port 174 and the corresponding fill plug 180 may be omitted. In such a case, the opening 198 of the filter housing 126 facilitates an entry of the lubricating oil into the inner chamber 120. To enable a filling of the inner chamber 120 with lubricating oil, the cap 202 is removed from the opening 198 of the filter housing 126.

The filter housing 126 further includes a bottom wall 210 integrally formed at a lower end 208 of the wall 192. The bottom wall 210 faces the header plate 170 and is substantially perpendicular to the wall 192. An outlet port 212 is formed into the bottom wall 210 and provides an opening for an exit of a filtered lubricating oil from the filter housing 126 to the inner chamber 120.

The filter housing 126 may further include a bypass conduit 214 that fluidly couples the cavity 194 of the filter housing 126 to the inner chamber 120 of the body 118. The bypass conduit 214 may extend outwardly from the wall 192 into the inner chamber 120. In an embodiment, the bypass conduit 214 may include a unidirectional valve (not shown) coupled to the bypass conduit 214, which allows a quantity of lubricating oil to flow only in one direction—that is from the cavity 194 towards the inner chamber 120. The unidirectional valve may be check valve that allows an exit of the lubricating oil into the inner chamber 120 when a pressure of the lubricating oil inside the cavity 194 exceeds a threshold value.

In one implementation, the body 118 (i. e. both the first portion 122 and the second portion 124) and the filter housing 126 may be formed from the same material. For example, the material may include polyamide, fibrous polyamide, high-grade plastic, nylon, and similar such materials. The material may be suitable for storing the lubricating oil at relatively high temperatures.

As shown in FIGS. 2 and 3, the filter 116 may include a cylindrical structure 220 having an outer surface 222, and an inner surface 224 defining a space 226 within the filter 116. The filter 116 is disposed inside the filter housing 126 (i.e. in the cavity 194) such that the outer surface 222 of the cylindrical structure 220 faces an inner surface of the wall 192. The filter 116 may be assembled (or inserted) into the filter housing 126 through the aperture 196 and be seated against the bottom wall 210 for assembly. In an assembled position of the filter 116, the space 226 is aligned with the outlet port 212 and may be co-axial with the outlet port 212. The cylindrical structure 220 is formed of a material suitable for filtering the lubricating oil received from the engine 102. The cylindrical structure is adapted to filter the lubricating oil as the lubricating oil passes through the cylindrical structure 220 from the outer surface 222 to the inner surface 224.

INDUSTRIAL APPLICABILITY

During operation, the pump 110 may power a flow of the lubricating oil from the tank 114 to the engine 102 via the outlet passage 160 and the supply conduit 108. A return of the lubricating oil may be facilitated through the return conduit 112. During a return, the lubricating oil may travel through the inlet conduit 186 and enter into the cavity 194 of the filter housing 126, and subsequently into the cylindrical structure 220 of the filter 116 positioned within the filter housing 126. As the lubricating oil enters the filter housing 126, the lubricating oil may flow around the filter 116 (in an annular space defined between the wall 192 and the outer surface 222 of the filter 116), cause a pressure to build-up in the annular space, and steadily flow into the cylindrical structure 220, so as to be filtered by the filter 116. During filtration, lubricating oil may flow across the cylindrical structure 220 of the filter 116, along a direction lateral to a height of the filter 116 and enter and accumulate into the space 226 of the filter 116. Since the space 226 of the filter 116 is fluidly coupled to the outlet port 212, the filtered lubricating oil flows into the inner chamber 120 through the outlet port 212. As a result, a filtered lubricating oil is received from the filter housing 126 by the inner chamber 120 and is stored by the tank 114 within the inner chamber 120.

On occasions, such as during cold conditions, when a pressure exerted by the lubricating oil on the outer surface 222 of the filter 116 becomes relatively high, the bypass conduit 214 may open (that is the unidirectional valve positioned in the bypass conduit 214 may open) and permit the lubricating oil to bypass the filter 116. Such a scenario may be contemplated when the lubricating oil becomes more viscous due to temperature of the lubricating oil dropping below a threshold temperature.

Given the inclusion and integration of the filter housing 126 within the inner chamber 120, a need for additional space for the filter housing 126 may be well avoided, making the tank 114 space efficient. Further, as the tank 114 may be formed of plastic and manufactured by the blow molding process, an overall cost of the tank 114 may be reduced. Also, an integration of the filter housing 126 with the body 118 of the tank 114 helps in reducing a cost and complexity associated with the dry sump lubrication system 104. This is because a separate positioning may include a use of clamps and fixtures to mount the filter 116, dedicated flow channels to route the lubricating oil flow to and from the filter 116, and similar such components and accessories, all of which may increase an overall cost and complexity of the dry sump lubrication system 104.

What is claimed is:

1. A tank for a dry sump lubrication system for an internal combustion engine, the tank comprising:

a body having a first portion, a second portion separable from the first portion, and defining an inner chamber; and a filter housing formed in one piece with the first portion and disposed partially inside the inner chamber and partially outside the inner chamber, the filter housing is configured to receive a filter, wherein the body and the filter housing are formed by a blow molding process, wherein the filter housing defines a first wall that extends into the inner chamber and a second wall that extends outside of the inner chamber, the first wall extending inside the inner chamber more than the second wall extends outside of the inner chamber, wherein the first and second walls define a cavity to house the filter, and wherein the first wall defines a bypass conduit that fluidly directly couples the cavity to the inner chamber.

2. The tank of claim 1, wherein the filter housing includes:

an aperture formed in the first portion and defining an opening of the cavity, wherein the opening facilitates a removal of the filter from the filter housing.

3. The tank of claim 1, wherein the filter housing includes a bottom wall and an outlet port formed in the bottom wall.

4. The tank of claim 1, further including an inlet conduit extending from the first portion of the body to the filter housing to facilitate a flow of a lubricating oil from the internal combustion engine to the tank.

5. The tank of claim 1, further including a base and an outlet passage formed in the base.

6. The tank of claim 1, wherein the second portion includes:

a side structure; and a bottom structure having a base and one or more side walls extending between the base and the side structure, wherein the one or more side walls being inclined relative to the base and the side structure.

7. The tank of claim 6, further including an outlet passage formed in the base.

8. The tank of claim 6, wherein the side structure includes one or more bulged portions to increase a volume of the inner chamber.

9. The tank of claim 1, wherein the tank further includes:

a vent port formed in the first portion for venting air from the inner chamber to an outside of the tank; and a fill port formed in the in the first portion to facilitate entry of a lubricating oil into the inner chamber.

10. The tank of claim 1, wherein the filter, when inside the cavity, does not extend past the second portion of the body in a height direction.

11. A dry sump lubrication system for an internal combustion engine, the dry sump lubrication system comprising:

a tank configured to store a lubricating oil, the tank including:

a body having a first portion, a second portion separable from the first portion, and defining an inner chamber; and a filter housing formed in one piece with the first portion and disposed partially inside the inner chamber and partially outside the inner chamber, wherein the body and the filter housing are formed by a blow molding process; and a filter disposed inside the filter housing and configured to filter the lubricating oil received from the internal combustion engine, wherein the filter housing defines a first wall that extends into the inner chamber and a second wall that extends outside of the inner chamber, the first wall extending inside the inner chamber more than the second wall extends outside of the inner chamber, wherein the first and second walls define a cavity to house the filter, and wherein the first wall defines a bypass conduit that fluidly directly couples the cavity to the inner chamber.

12. The dry sump lubrication system claim 11, wherein the filter housing includes:

an aperture formed in the first portion and defining an opening of the cavity, wherein the opening facilitates a removal of the filter from the filter housing.

13. The dry sump lubrication system claim 11, wherein the filter housing includes a bottom wall and an outlet port formed in the bottom wall, wherein the outlet port facilitates an outlet of lubricating oil from the filter housing to the inner chamber.

14. The dry sump lubrication system claim 11, further including an inlet conduit extending from the first portion of the body to the filter housing to facilitate a flow of the lubricating oil from the internal combustion engine to the filter housing.

15. The dry sump lubrication system claim 11, further including a base and an outlet passage formed in the base, the outlet passage facilitates a flow of the lubricating oil from the inner chamber to the internal combustion engine.

16. The dry sump lubrication system claim 11, wherein the second portion includes:

a side structure; and a bottom structure having a base and one or more side walls extending between the base and the side structure, wherein the one or more side walls being inclined relative to the base and the side structure.

17. The dry sump lubrication system claim 16, further including an outlet passage formed in the base, the outlet passage facilitates a flow of the lubricating oil from the inner chamber to the internal combustion engine.

18. The dry sump lubrication system claim 16, wherein the side structure includes one or more bulged portions to increase a volume of the inner chamber.

19. The dry sump lubrication system claim 11, wherein the tank further includes:

a vent port formed in the first portion for venting air from the inner chamber to an outside of the tank; and a fill port formed in the in the first portion to facilitate entry of the lubricating oil into the inner chamber.

20. The dry sump lubrication system claim 11, wherein the filter, when inside the cavity, does not extend past the second portion of the body in a height direction.

* * * * *